US009617053B2

(12) United States Patent
Fisher et al.

(10) Patent No.: US 9,617,053 B2
(45) Date of Patent: Apr. 11, 2017

(54) RECLOSABLE FLEXIBLE PACKAGES FOR FOOD PRODUCTS

(75) Inventors: Thad J. Fisher, DeForest, WI (US); Charles W. Halgren, East Hanover, NJ (US); Kadir Karul, Racine, WI (US); Mark Armstrong, Gwynedd (GB)

(73) Assignee: Koninklijke Douwe Egberts B.V., Utrecht (NL)

( * ) Notice: Subject to any disclaimer, the term of this patent is extended or adjusted under 35 U.S.C. 154(b) by 482 days.

(21) Appl. No.: 13/536,942

(22) Filed: Jun. 28, 2012

(65) Prior Publication Data

US 2014/0001250 A1 Jan. 2, 2014

(51) Int. Cl.

| | |
|---|---|
| ***B65D 75/00*** | (2006.01) |
| ***B65D 75/58*** | (2006.01) |
| ***B65D 33/16*** | (2006.01) |
| ***B65D 77/16*** | (2006.01) |
| ***B65B 9/20*** | (2012.01) |

(52) U.S. Cl.

CPC ..... *B65D 75/5827* (2013.01); *B65B 9/20* (2013.01); *B65B 9/2056* (2013.01); *B65D 33/1616* (2013.01); *B65D 77/16* (2013.01)

(58) Field of Classification Search

CPC ..... B65D 33/007; B65D 75/5827; B65D 33/1616; B65D 77/16; A22C 13/023; A23B 4/00; A23L 3/00; A45C 13/10; B65B 9/20; B65B 9/2056

USPC ..... 383/70, 200, 203, 204, 207, 209; 229/125.01, 214; 222/1; 53/450

See application file for complete search history.

(56) References Cited

U.S. PATENT DOCUMENTS

| | | | | |
|---|---|---|---|---|
| 924,681 A | | 6/1909 | Ludescher | |
| 1,431,918 A | | 10/1922 | Arthur | |
| 2,009,511 A | * | 7/1935 | Nydegger | 229/87.01 |
| 2,474,120 A | | 6/1949 | Rumsey, Jr. | |
| 2,700,518 A | | 1/1955 | Ryno et al. | |
| 2,723,779 A | * | 11/1955 | Parker et al. | 222/104 |
| 2,873,905 A | * | 2/1959 | Denton | 383/22 |

(Continued)

FOREIGN PATENT DOCUMENTS

| | | |
|---|---|---|
| CN | 1042120 A | 5/1990 |
| EP | 0 366 175 A1 | 5/1990 |

(Continued)

OTHER PUBLICATIONS

International Search Report and Written Opinion of the International Searching Authority, mailed Sep. 26, 2013 in International Application No. PCT/US2013/047254 (8 pages).

(Continued)

*Primary Examiner* — Peter Helvey
(74) *Attorney, Agent, or Firm* — Fitch, Even, Tabin & Flannery LLP

(57) ABSTRACT

A reclosable flexible package for storing a food product and a method of manufacture thereof are provided. The package includes a flexible film side wall, a closed first end, a closed second end portion that can be separated from the side wall to provide an access opening, and a collar. The collar can be formed in the side wall or attached to the side wall. The collar is more rigid than adjacent portions of the side wall and is rotatable about the longitudinal axis of the package to twist portions of the side wall and block access to the opening after removal of the second end portion.

26 Claims, 7 Drawing Sheets

(56) References Cited

U.S. PATENT DOCUMENTS

| | | | | | |
|---|---|---|---|---|---|
| 3,542,566 | A | * | 11/1970 | Wakefield | 206/216 |
| 3,556,390 | A | | 1/1971 | Gould et al. | |
| 3,608,032 | A | | 9/1971 | Boultinghouse | |
| 3,856,143 | A | * | 12/1974 | Simon et al. | 206/438 |
| 3,901,433 | A | * | 8/1975 | Jacobs et al. | 232/1 R |
| 3,958,393 | A | * | 5/1976 | Whitener | 53/469 |
| 4,610,039 | A | | 9/1986 | Stern | |
| 4,721,397 | A | * | 1/1988 | Knutar | 383/70 |
| 4,768,887 | A | * | 9/1988 | Kimura | 383/71 |
| 4,810,103 | A | * | 3/1989 | Bell | 383/70 |
| 4,850,528 | A | | 7/1989 | Hanus | |
| 4,898,477 | A | * | 2/1990 | Cox et al. | 383/33 |
| 5,174,658 | A | * | 12/1992 | Cook et al. | 383/33 |
| 5,184,896 | A | * | 2/1993 | Hammond et al. | 383/33 |
| 5,676,306 | A | | 10/1997 | Lankin et al. | |
| 6,022,144 | A | * | 2/2000 | Hausslein | 383/33 |
| 6,044,757 | A | * | 4/2000 | Mason | 99/645 |
| 6,161,474 | A | | 12/2000 | Mason | |
| 7,681,784 | B2 | | 3/2010 | Lang | |
| D616,301 | S | | 5/2010 | Stephens | |
| 7,726,551 | B2 | | 6/2010 | Abbott | |
| D620,793 | S | | 8/2010 | Stephens | |
| 2006/0177161 | A1 | * | 8/2006 | Turvey | 383/120 |
| 2009/0001080 | A1 | | 1/2009 | Mirabile et al. | |
| 2011/0095074 | A1 | | 4/2011 | Stephens | |
| 2014/0216963 | A1 | * | 8/2014 | Whitney et al. | 206/316.1 |

FOREIGN PATENT DOCUMENTS

| | | | |
|---|---|---|---|
| JP | 2002103484 | A | 4/2002 |
| JP | 2007320604 | A | 12/2007 |
| JP | 2008133051 | A | 6/2008 |
| JP | 2012025453 | A | 2/2012 |
| JP | 2012056612 | A | 3/2012 |

OTHER PUBLICATIONS

Notification of the First Office Action, dated Dec. 21, 2015 for Chinese Patent Application No. 201380034486.4, English translation (9 pgs.)

First Examination Report, dated May 26, 2015 for New Zealand Patent Application No. 631064 (3 pgs.)

Office Action dated Nov. 17, 2015 for Ukrainian Patent Application No. a201413825, English translation (2 pgs.)

Patent Examination Report No. 1, dated Aug. 10, 2015, for Australian Patent Application No. 2013280703 (3 pgs.)

Notification of a Requisition by the Examiner, dated Oct. 27, 2015 for Canadian Patent Application No. 2,876,914 (4 pgs.)

Notice of Reasons for Rejection, dated Feb. 1, 2016 for Japanese Patent Application No. 2015-520350, English translation (9 pgs.)

* cited by examiner

RECLOSABLE FLEXIBLE PACKAGES FOR FOOD PRODUCTS

FIELD

Packages for food products are described herein, and in particular, reclosable flexible packages for food products.

BACKGROUND

Flexible packages are commonly used to store food products such as crackers, cookies, candy, and the like. Consumers frequently dispense some of the food product from the package and attempt to reclose the package so that the food product remaining in the package is preserved in fresh form. Many packages are not provided with a reclose feature, causing the consumers to twist and/or fold the package in an attempt to reclose it. However, the flexible material from which the package is made tends to untwist and/or unfold and causes the package to open.

SUMMARY

A reclosable package containing a food product is provided. The package comprises a flexible film side wall, a closed first end, a closed second end portion configured to be separable from the side wall to provide an access opening for removal of the food product, and a longitudinal axis passing through the first and second ends. The side wall is configured to form, a collar proximate the opening. The collar is more rigid than adjacent portions of the side wall and configured to rotate about the longitudinal axis and twist at least a portion of the side wall to block the access opening after removal of the second end portion.

A method of dispensing the food product from the foregoing package is also provided. The method comprises separating the second end portion from the side wall of the package; moving the collar in a direction toward the first end of the bag to expose the food product; removing a portion of the food product from the package through the opening; moving the collar in a direction away from the first end of the bag to a position above a top surface of the food product remaining in the bag; rotating the collar about the longitudinal axis to twist a portion of the side wall and block the access opening; and sliding the collar in a direction toward the first end of the bag over the side wall with the opening being blocked by the twisted portion of the side wall.

A method of manufacturing the recloseable flexible package described herein is also provided. The method comprises providing a continuous film of packaging material in the form of a tube; sealing portions of the film to form the first and second ends of the package; and forming the collar in the film between the first and second ends. The collar is more rigid than adjacent portions of the film and more proximate to the second end than to the first end.

Another flexible reclosable package containing a food product is provided. The package comprises a flexible film bag having a side wall, a closed first end, a closed second end portion configured to be separable from the side wall to provide an access opening, a longitudinal axis passing through the first and second ends, and a collar attached to the side wall between the second end portion and the first end. The second end portion extends above the collar. The collar is more rigid than the side wall and is configured to rotate about the longitudinal axis to twist at least a portion of the side wall and block the access opening after removal of the second end portion.

The side wall of the package can include one or more score lines above the collar configured to permit the second end portion to be separated from the side wall along the one or more score lines. The collar can be dimensioned to slide over the side wall in a direction toward the first end of the bag after the rotation of the collar about the longitudinal axis and with a portion of the side wall being twisted. The collar can be formed in an exterior surface or an interior surface of the side wall. The collar and the side wall can be configured such that the collar can be rotated at least one full revolution about the longitudinal axis to reduce a maximum height of the package. The collar can include a threaded portion and a sealing cap can be engaged to the collar via the threaded portion. The collar may have a complete or incomplete perimeter. The package can include a fin seal extending along the longitudinal axis, and the collar can have first and second ends spaced apart from the fin seal and being on opposite sides of the fin seal.

The method may further comprise moving the first and second ends of the film toward each other to form at least one portion of film having an accordion shape. The method may further comprise using sealing jaws to compress at least one of the accordion-shaped portions of the film.

The flexible packages may be opened without undermining the structural integrity of the side wall, are reclosable so that the food product may be preserved in fresh form until it is fully consumed, and may include a tamper-evident, indicator. These reclosable packages can be entirely made of one material and provide an inexpensive, easy to manufacture alternative to the packages presently available.

DETAILED DESCRIPTION

Figure 1:
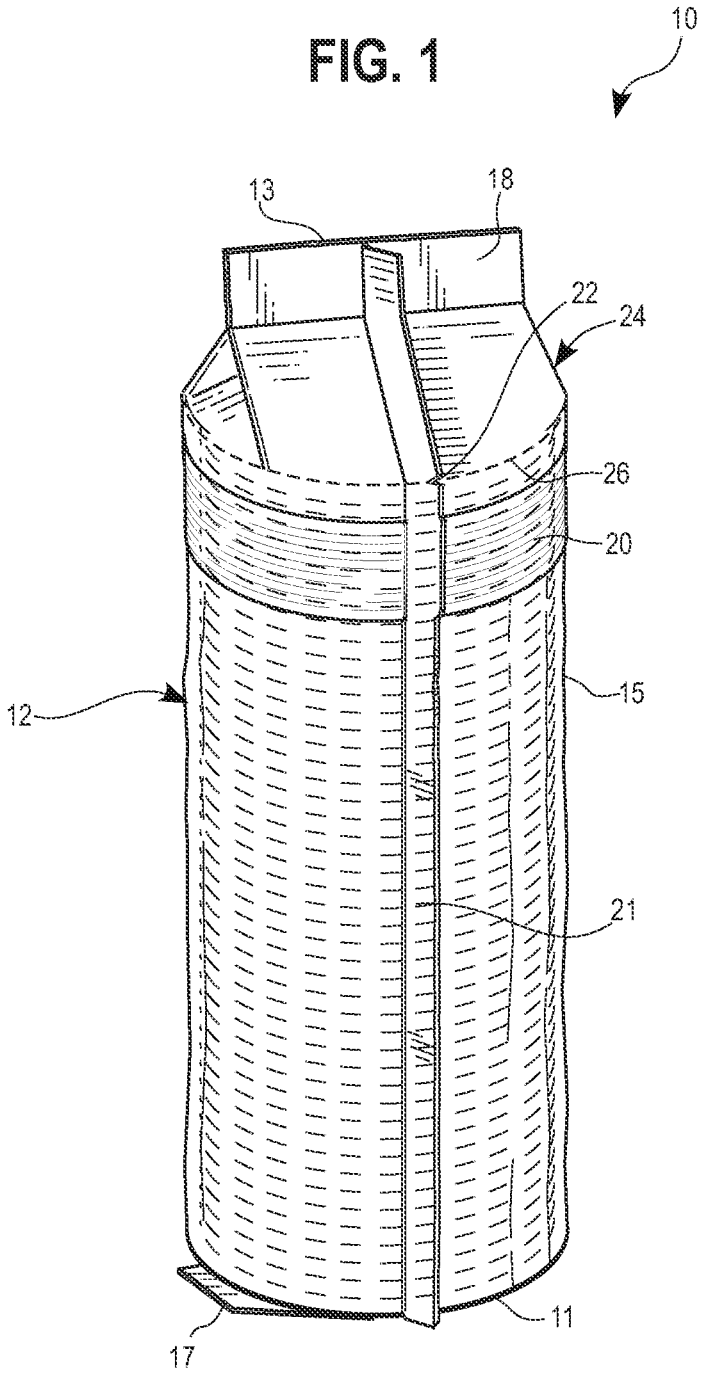
FIG. 1 is a side perspective view of an exemplary flexible reclosable package containing a stack of food products, shown in phantom lines for clarity.

With reference to FIGS. 1-7, an exemplary flexible reclosable food package 10 is provided. The package 10 is in the form of an elongated, cylindrical bag and includes a side wall 12, a bottom end 11, and a top end 13 opposite the bottom end 11. The side wall 12 has an interior surface 14 and an exterior surface 15. The side wall 12, bottom end 11, and top end 13 define a hollow interior 16 where a food product 30 can be stored. For example only, the food product 30 may be a stack of crackers or cookies, wafers, chocolates, cheese bits, raisins, nuts, grains, candy, and the like.

As shown in FIG. 1, the bottom end 11 is closed and includes a first cross seal 17, and the top end 13 is closed and includes a second cross seal 18. A fin seal 21 extends between the bottom and top ends 11 and 13 of the package 10. The fin seal 21 may interconnect the first and second cross seals 17 and 18. The package further includes a collar 20 formed in the side wall 12. The collar 20 is more rigid than adjacent portions of the side wall 12.

The package 10 may further include a removable top end portion 24 formed in the side wall 12 above the collar 20. The top end portion 24 may be separated from the package 10 along one or more score lines 26 formed in the side wall 12. A score line will be understood to be any line of weakness formed in the side wall 12 of the package 10. The score line in the side wall 12 can be formed by ablation with a laser, but may be formed by other suitable techniques, for example, die-cutting or micro-abrasion. It will be appreciated that although the score lines 26 are shown as being formed in the exterior surface 15 of the package 10, the score lines 26 may be formed in the interior surface 14 of the package 10.

With reference to FIG. 1, the score lines 26 can be between the top end 13 and the collar 20 such that the top end portion 24 is fully above the collar 20. Alternatively, the score lines 26 may be between the collar 20 and the first end 11 of the package 10 such that the top end portion 24 extends below the collar 20. The removable top end portion 24 provides a tamper-evident feature such that the absence of, or damage in, the top end portion 24 could indicate that the package 10 has been previously opened and/or damaged.

The fin seal 21 may include a tear notch 22 as shown in FIG. 1. The notch 22 may be formed by a laser cutting through a portion of the fin seal 21, or by other cutting techniques such as a die cut. The notch 22 provides a tear initiation site that facilitates the separation of the top end portion 24 from the package 10 along the score lines 26. It will be appreciated that the package 10 may include only one notch 22 or two or more notches.

Figure 2:
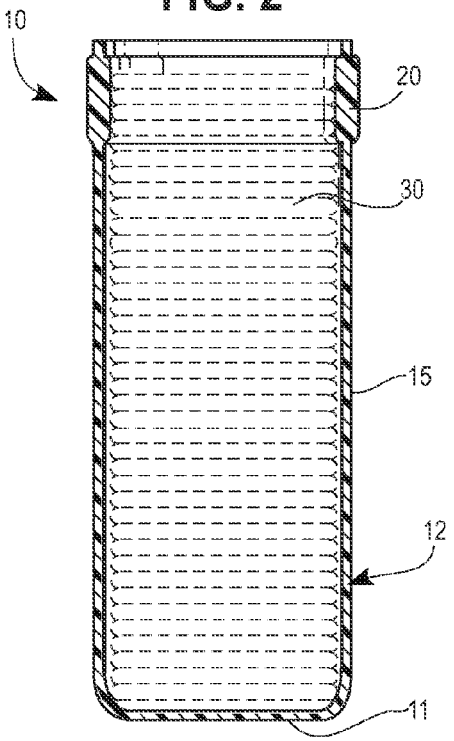
FIG. 2 is a side elevational view in partial section of the package of FIG. 1 shown without the second end portion.
Figure 5:
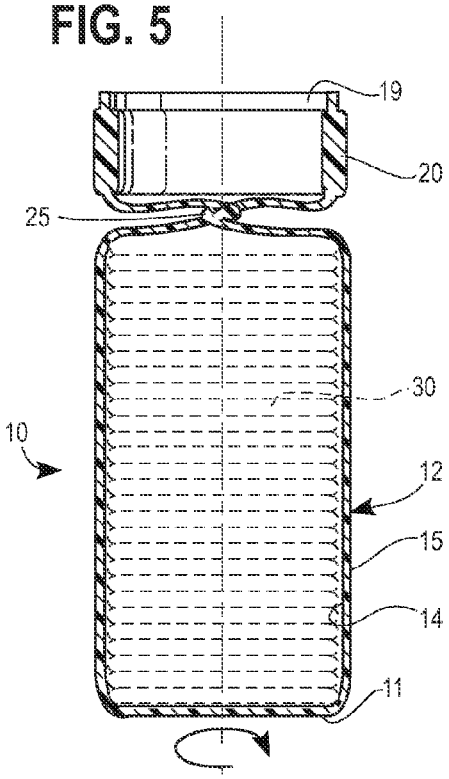
FIG. 5 is a side elevational view in partial section of the package of FIG. 1 shown with the collar being rotated in the direction shown to twist portions of the side wall.

In order to open the package 10, a user can grasp the fin seal 21 proximate the notch 22 and tear the fin seal 21 in a direction along the notch 22. The tear leads through the fin seal 21 and follows along the score lines 26, separating the top end portion 24 and the second seal 18 from the rest of the package 10 to provide an access opening 19 and expose the food, product 30 to the user, as shown in FIG. 2. A longitudinal axis passes through the opening 19 and the bottom end 11 of the package 10 as shown in FIG. 5.

Figure 3:
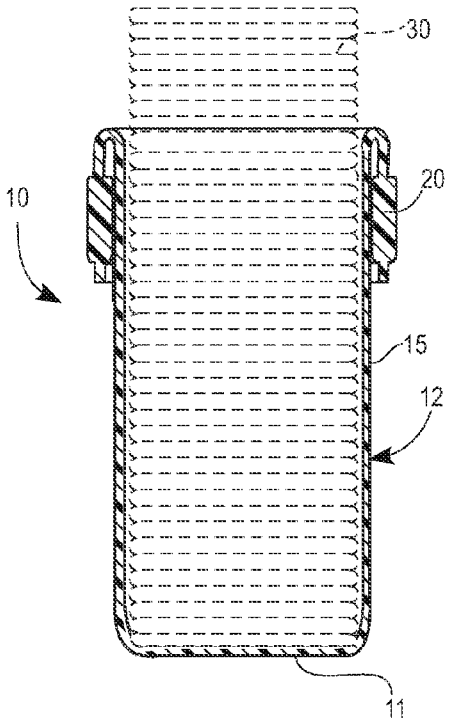
FIG. 3 is a side elevational view in partial section of the package of FIG. 1 shown with the food product exposed.

In order to provide the user with access to the food product 30 in the package 10, the collar 20 can be moved by the user downwardly in a direction toward the bottom end 11 of the package 10. This downward or "peel back" sliding movement of the collar 20 and the side wall 12 further exposes the food, product 30 to the user as shown in FIG. 3, and permits the user to remove one or more portions of the food product 30 from the package 10.

Figure 4:
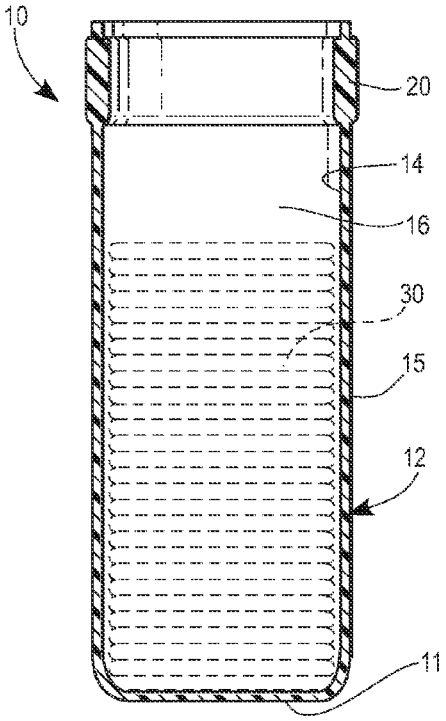
FIG. 4 is a side elevational view in partial section of the package of FIG. 1 shown with the collar being moved up after the desired portion of the product has been removed.

After the user has removed some but not all of the food product 30 from the package 10, the user may move the collar 20 by sliding it over the side wall 12 upwardly in the direction away from the bottom end 11 of the package 10 to a position above the top surface of the food product 30 remaining in the package 10, as shown in FIG. 4.

With continuing reference to FIG. 4, the portion of the side wall 12 including the collar 20 of the package 10 is sufficiently rigid such that the side wall 12 does not lose its structural integrity and remains upright even after the side wall 12 is no longer in frictional engagement with the portions of the food product 30 removed by the user. Additionally, the collar 20 is sufficiently rigid to prevent the portion of the side wall 12 that forms the mouth of the opening 19 from collapsing inward. As such, the mouth of the opening 19 is preserved in a suitable accessible configuration, for example, a circular, oval, or C-shape.

With reference to FIG. 5, in order to reclose the package 10, the user can rotate the collar 20 in a clockwise or counterclockwise direction about the longitudinal axis. Since the collar 20 is formed in the side wall 12 of the package 10, a portion of the flexible side wall 12 turns during the rotation of the collar 20 to form a twisted, configuration 25 that substantially closes and blocks access to the access opening 19.

Depending on the amount of the food product 30 removed from, the package 10 by the user, the collar 20 may be rotated by an appropriate number of revolutions such that collar 20 can travel downward toward the bottom end 11 of the package 10 and into close proximity with the top surface of the remaining food product 30. As more and more of the food product 30 is removed by the user from the package 10, the user can reclose the package 10 by rotating the collar 20 by more and more revolutions about the longitudinal axis. For example, the collar 20 may be rotated by one quarter revolution, by one half revolution, from one half to one full revolution, from one to two full revolutions, from two to three full revolutions, or more full revolutions about the longitudinal axis.

Figure 6:
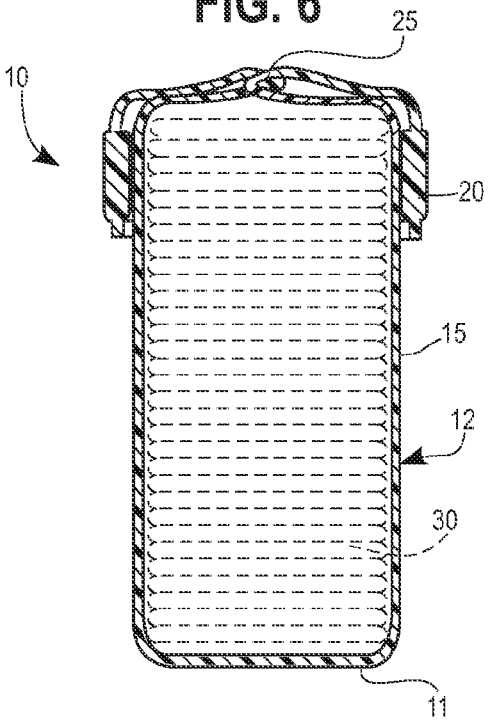
FIG. 6 is a side elevational view in partial section of the package of FIG. 1 shown with the collar being in the closed position.

After the rotation of the collar 20 and the formation of the twisted configuration 25 that substantially closes the opening 19, the collar 20 may be again moved in a downward direction toward the first end 11 of the package 10 into a closed position, shown in FIG. 6. In particular, the collar 20 slides over the side wall 12 in frictional engagement with the side wall 12 to a closed position where the twisted configuration 25 of the side wall 12 forms a multi-layer covering that blocks access to the opening 19.

When the collar 20 is in the closed position, the frictional engagement of the collar 20 with the exterior surface 15 of the side wall 12 and the frictional engagement of the interior surface 14 of the side wall 12 with the food product 30 remaining in the package can restrict the collar 20 from disengaging the side wall 12 and moving in a direction away from the bottom end 11, which would have lead to the counter-rotation of the collar 20, untwisting of the twisted configuration 25, and the inadvertent opening of the opening 19.

Figure 7:
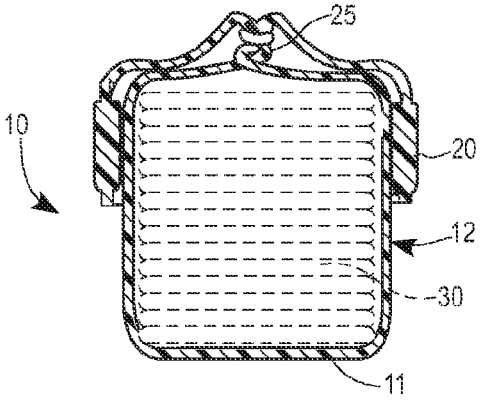
FIG. 7 is a view similar to FIG. 3, but with a larger portion of the product having been removed by the user.

It is to be appreciated that a maximum height of the package 10 in the closed position depends on the amount of the food product 30 removed by the user. In particular, as the height of the stack or the volume of the food product 30 decreases, the collar 20 can be moved further down along the side wall 12 toward the bottom end 11 of the package 10, progressively decreasing the maximum height of the package 10. For example, after approximately one third of the food product 30 has been removed by the user, as shown in FIG. 4, the maximum height of the package 10 in the closed position decreases by approximately one third relative to the full package shown in FIG. 2. Similarly, after more than one half of the food product 30 has been removed from the package 10, as shown in FIG. 7, the maximum height of the package 10 in the closed position decreases by more than one half relative to the maximum height of the container 10 of FIG. 2.

In order to reopen the package 10 after it has been reclosed, the collar 20 can be moved by sliding over the side wall 12 in an upward direction away from the bottom end 11 of the package 10 and counter-rotated to untwist the twisted configuration 25 such that the opening 19 becomes substantially open. The collar 20 can be then moved by sliding over the side wall 12 in a direction toward the bottom end 11 of the package 10 to "peel back" the side wall 12 of the package 10 and make the food product 30 accessible to the user. After the user removes the desired portion of the food product 30 from the package 10, the food product 30 remaining in the package 10 can be again reclosed as discussed above.

The package 10 may be made from a polymeric, flexible film. The flexible film may be made from various materials, including, but not limited to, polyethylene, polypropylene, polyester, foil laminates, and the like. The flexible film may also be laminated and optionally include a metalized layer. The package 10 can have a length as measured, from the top end 13 to the bottom end 11 of about 4 inches (100 millimeters) to about 12 inches (300 millimeters), and a width of about 2 inches (50 millimeters) to about 6 inches (150 millimeters). The side wall 12 of the package 10 may have one or more layers and may have a thickness of about 0.004 inches (0.1 millimeters) to about 0.12 inches (3 millimeters). It is to be appreciated that, the dimensions of the package 10 have been provided for illustration purposes only, and that the principles of this disclosure can be utilized in connection with flexible film packages of any size.

While the package 10 and the collar 20 have been shown as being circular, both the package 10 and the collar 20 may be of various other shapes, for example, triangular, rectangular, square, oval, etc. Further, it is to be appreciated that while the side wall 12 of the package 10 OF FIG. 1 has been shown as not being pre-twisted to form the twisted configuration 25 that closes the opening 19, the package 10 may have a side wall 12 that is pre-twisted with the collar 20 being in a closed position as shown, for example, in FIG. 6. Such a pre-twisted configuration can require the user, after separating the top end portion 24 from the package 10, to untwist the side wall 12 by rotating the collar 20 and moving the collar 20 in a direction away from the bottom end 11 of the package 10 to an open position as shown in FIG. 4. In addition, the pre-twisted configuration could provide a tamper-evident feature for the package 10 such that the absence of the pre-twisted configuration could indicate that the package 10 has been previously opened. In another approach, a peelable film can be sealed to the collar 20 and provide an additional tamper-evident feature for the package 10.

Figure 9:
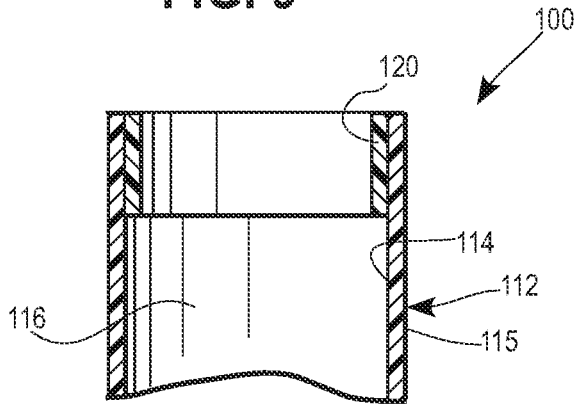
FIG. 9 is a partial sectional side view of an exemplary package of another exemplary flexible package shown with the collar being formed in the interior surface of the side wall.
Figure 10:
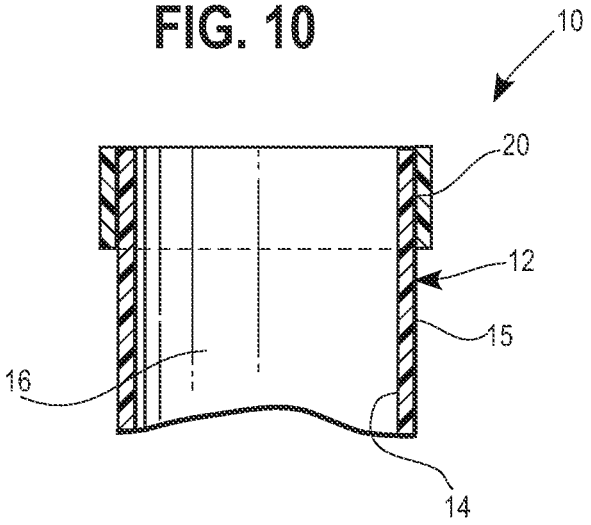
FIG. 10 is a partial sectional side view of the side wall and collar of the package of FIG. 1.

The collar 20 of the package 10 can be formed in the exterior surface 15 of the side wall 12 of the package 10, as shown in FIG. 10. Alternatively, a collar 120 may be formed in the interior surface 114 of the side wall 112 such that the collar 120 is at least partially located within the hollow interior 116 of the package 100, as shown in FIG. 9. It is to be appreciated that the rigidity of the collar 20, collar 120, or any portion of the side walls 12 and 112 of the packages 10 and 100 may be increased, via selective curing by UV light or another suitable technique.

As shown in FIG. 1, the upper edge collar 20 can be parallel and positioned in close proximity to the score lines 26 along which the top end portion 24 is separated from the side wall 12 of the package 10. Since the collar 20 is more rigid, than adjacent portions of the side wall 12, the close proximity of the collar 20 to the score lines 26 restricts the deviation of the tear line and facilitates a predictable and consistent path for the separation of the collar 20 along the score lines 34.

Figure 8:
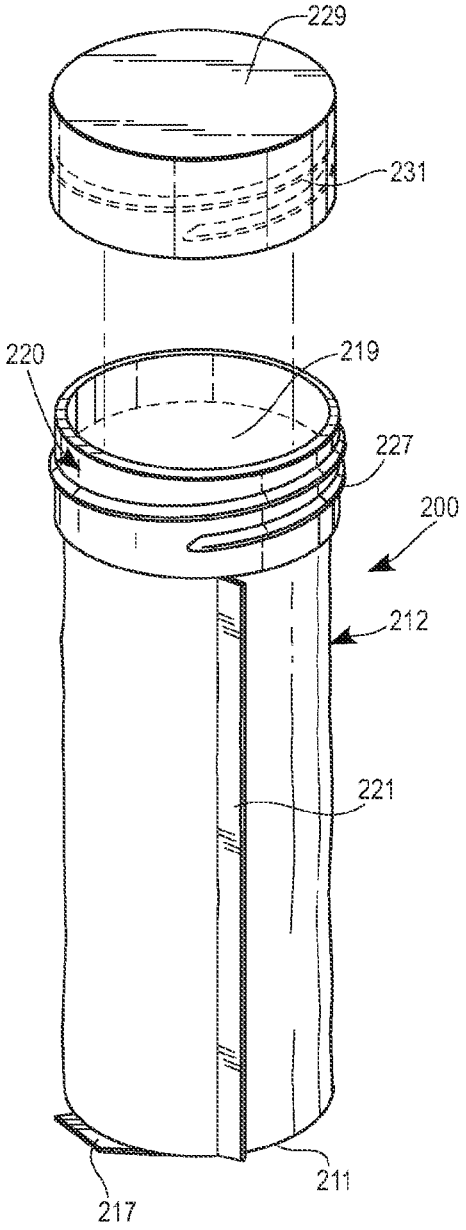
FIG. 8 is a side perspective view of another exemplary flexible reclosable package.

Optionally, instead of being formed in the side wall 12 from the same material as the side wall 12, the collar 20 may be in the form of a rigid ring 220 attached to a side wall 212 of the package 200, as shown in FIG. 8. The collar 220 may be attached to the side wall 212 by adhesives, bonding, fusion, or the like. The ring 220 may be made from a plastic or any other suitable material that is more rigid than the material (or materials) from which the side wall 212 is made. Further, the collars 20 and 220, or any other portion of the side wall of the packages 10 and 200, may be UV cured to form a threaded surface. For example, the threaded surface 227 may allow a sealing cap 229 having complementary threads 231 to be removably attached to the package 200, as shown in FIG. 8. Also, a nozzle, spout, or another dispensing mechanism may be removably coupled to the threaded collar 220 or to the side wall 212 of the package 200 to provide a dispenser for the food product stored in the package 200.

Figure 11A:
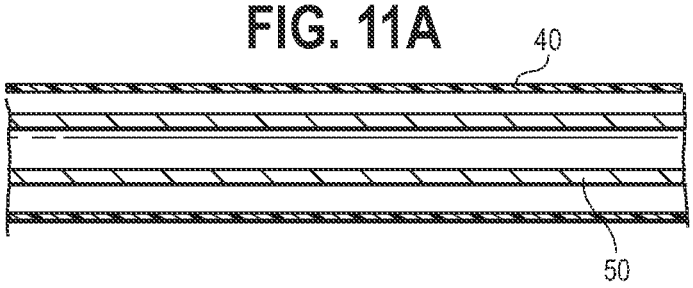
FIGS. 11A-11D illustrate an exemplary method of manufacturing the flexible package of FIG. 1.
Figure 11B:
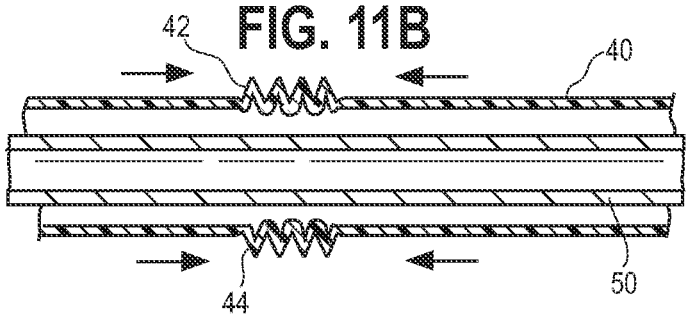

Referring to FIGS. 11A-11D, a method of making the package 10 is shown. As shown in FIG. 11A, the flexible film 40 moves along the forming tube 50. The first and second ends of the film 40 can be pushed in a direction toward one another to form a first accordion region 42 and a second accordion region 44 each having multiple folds or layers of the film 40, as shown in FIG. 11B.

Figure 11C:
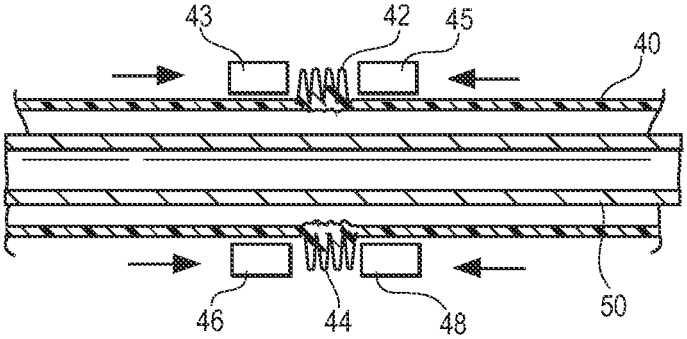
Figure 11D:
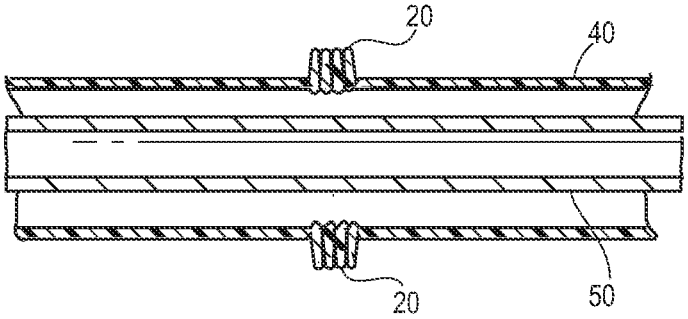

After the formation of the accordion regions 42 and 44, sealing jaws 43 and 45 and sealing jaws 46 and 48 can be moved toward one another to press together the accordion regions 42 and 44, respectively, as shown in FIG. 11C. This compression of the accordion regions 42 and 44 results in the formation of the ring-shaped collar 20, as shown in FIG. 11D. Subsequently, additional sealing jaws can form the first and second cross seals 17 and 18 and a fin seal 21 of the package 10 of FIG. 1.

While the collar 20 is shown as being formed by folding the film 40, the collar may be formed by rolling the film 40 over several times during the manufacturing process. It will be appreciated that since the collar 20 is formed in the film 40 via the creation of multiple folds of film 40, the collar 20 has a greater thickness and thus greater rigidity than adjacent portions of the film 40 which will comprise the side wall 12 of the package 10. Further, while the collar 20 can be formed in the exterior surface of the film 40, as shown in FIGS. 11A-11D, it will be appreciated that the collar 20 can likewise be made in the interior surface of the film 40 to result in the collar 120 substantially as shown in FIG. 9.

Figure 12:
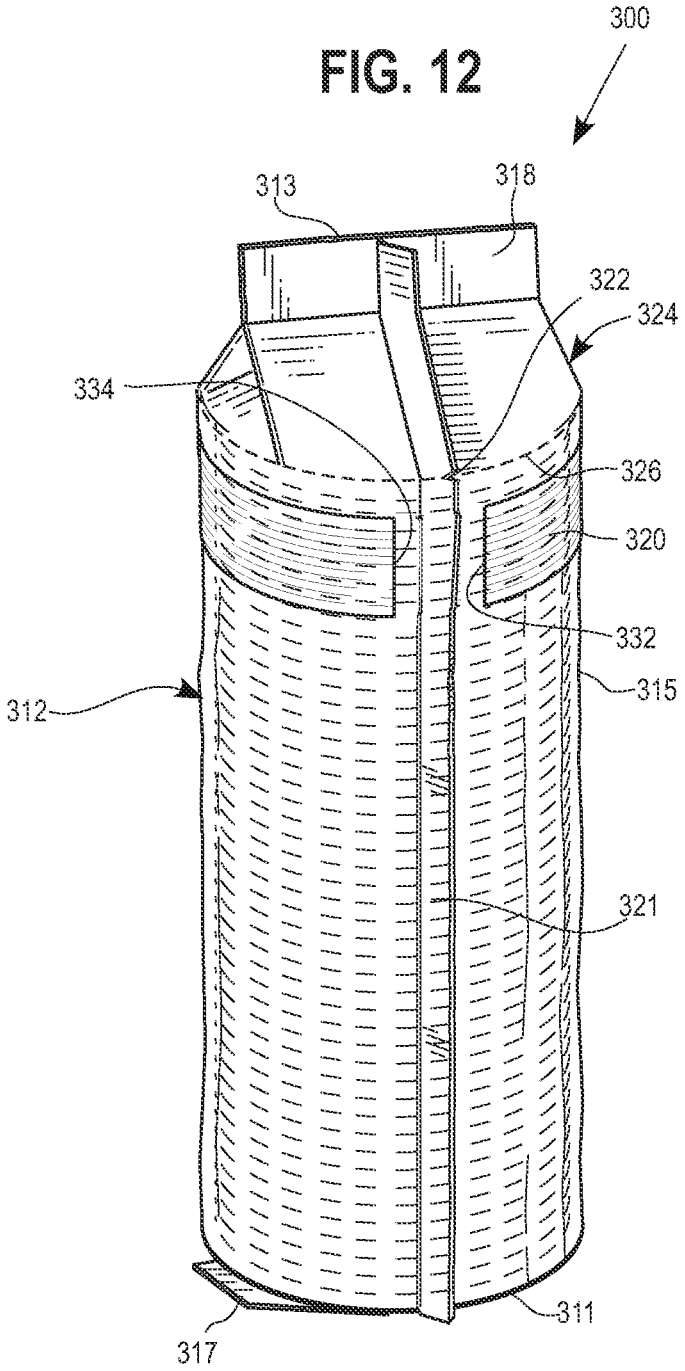
FIG. 12 is a side perspective view of another exemplary flexible reclosable package containing a stack of food products, shown in phantom lines for clarity.
Figure 13:
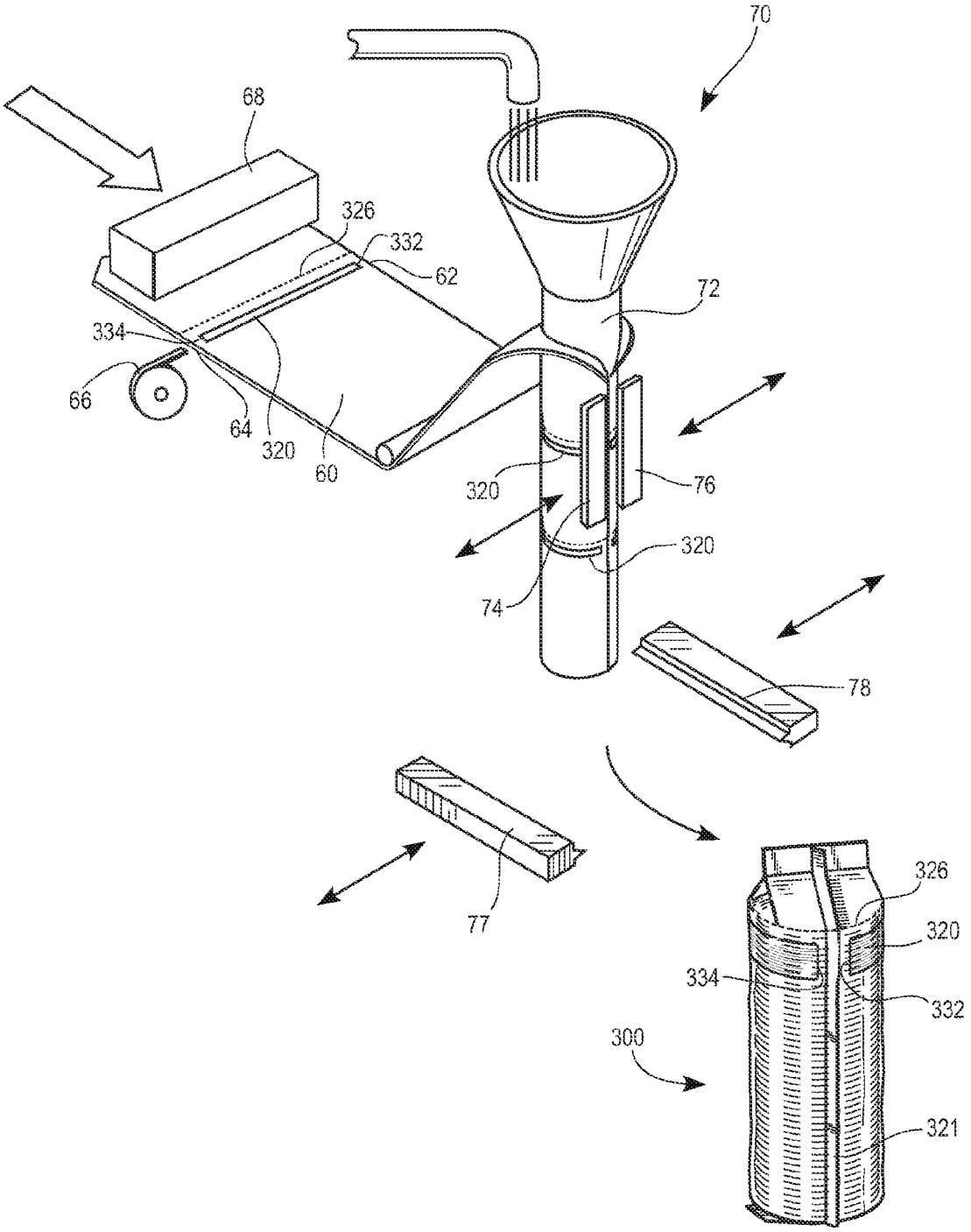
FIG. 13 is a perspective view of relevant portions of a vertical-form-fill-and-seal device during the manufacture of the package of FIG. 12.

With reference to FIGS. 12-13, another exemplary flexible reclosable food package 300 is provided. The package 300 is similar to the packages 10 and 200, but unlike the collars 20 and 220 of the packages 10 and 200, which are closed and surround the entire perimeter of the packages 10 and 200, respectively, the collar 320 is open with a gap between end segments. In particular, the collar 320 has a first end 332 and a second end 334 that are spaced apart from each other. The first and second ends 332 and 334 are located on opposite sides of the fin seal 321 of the package 300. The first and second ends 332 and 334 can be equidistant from the fin seal 321 as shown in FIG. 12. Optionally, one of the first and second ends 332 and 334 of the collar 320 may be closer to the fin seal 321 than the other end of the collar 320.

It is to be appreciated that the collar 320 can reclose the package 300 the same way as the collars 20 and 220 reclose the packages 10 and 200, respectively. In order to reclose the package 300, the user can rotate the collar 320 in a clockwise or counterclockwise direction about the longitudinal axis to turn a portion of the flexible side wall 312 and form a twisted configuration that substantially closes the package 300 like the twisted configuration 25 shown in FIG. 5.

With reference to FIG. 13, an exemplary method for manufacturing the package 300 is shown. As flexible film material 60 is being fed in the machine direction toward a vertical-form-fill-and-seal device 70, a supply roller 66 can be used to apply to either surface of the film 60 a material that forms the collar 320, and a laser applicator 68 can be used to score the flexible film material 60 to form the score lines 326. As shown in FIG. 13, the collar 320 does not extend across the entire width of the film 60. Instead, a first gap is formed between the first end 332 of the collar 320 and the first edge 62 of the film 60, and a second gap is formed between the second end 334 of the collar 320 and the second edge 64 of the film 60.

As the flexible film 60 is being fed over a forming tube 72 of the vertical-form-fill-and-seal device 70, the film 60 is folded around the forming tube 72 and the areas of the film 60 that include the gaps 62 and 64 are sealed to each other along a vertical direction by a pair of longitudinal sealing jaws 74 and 76 to form the fin seal 321. The film 60 is then sealed in a horizontal direction by a pair of transverse sealing jaws 77 and 78 to form the top and bottom cross seals 317 and 318. The jaws 87 and 88 can also be used to either cut or pull away the film 60 to singulate the package 300 having a collar 320 configured as discussed above in reference to FIG. 12. Accordingly, spacing the collar 320 from the fin seal 321 permits sealing of the fin seal 321 in the absence of the excess thickness of material that the collar 320 would add if present in the fin seal area.

These teachings describe cost-effective and easy to manufacture reclosable flexible packages for food products. The flexible packages have a removable tamper-evident feature and a reclose feature that is more rigid than adjacent portions of the side wall of the package. These reclosable flexible packages can be made entirely from the same material to increase manufacturing efficiency and reduce manufacturing costs.

Those skilled in the art will recognize that, a wide variety of modifications, alterations, and combinations can be made with respect to the above described embodiments without departing from the spirit and scope of the invention, and that such modifications, alterations, and combinations are to be viewed as being within the ambit of the concept.

The invention claimed is:

1. A reclosable package containing a food product, the package comprising a flexible film side wall, a closed first end, a closed second end portion configured to be separable from the side wall to provide an access opening for removal of the food product, a longitudinal axis passing through the first and second ends, the side wall being configured to form a collar proximate the opening, the collar being more rigid than adjacent portions of the side wall and configured to rotate about the longitudinal axis and twist at least a portion of the side wall to block the access opening after removal of the second end portion, the closed second end portion being spaced from the collar by a portion of the flexible film side wall extending above the collar.

2. The package of claim 1, wherein the collar is dimensioned to slide over the side wall in a direction toward the first end of the bag after the rotation of the collar about the longitudinal axis and with a portion of the side wall being twisted.

3. The package of claim 1, wherein the side wall has an exterior surface, the collar being formed in the exterior surface of the side wall.

4. The package of claim 1, wherein the side wall has an interior surface, the collar being formed in the interior surface of the side wall.

5. The package of claim. 1, wherein the collar and side wall are configured such that the collar can be rotated at least one full revolution about the longitudinal axis.

6. The package of claim 5, wherein rotation of the collar reduces a maximum, height of the package by more than one half.

7. The package of claim 1, wherein the side wall includes one or more score lines above the collar configured to permit the second end portion to be separated from the side wall along the one or more score lines.

8. The package of claim 1, wherein the collar includes a threaded portion to permit a sealing cap to be engaged to the collar via the threaded portion.

9. The package of claim 1, wherein a sealing cap is engaged to the collar, the sealing cap being removable from the collar by rotation about the longitudinal axis.

10. The package of claim 1, further comprising a spout removably engaged to the collar, the spout being configured to dispense the food product stored in the package.

11. The package of claim 1, wherein the collar is closed.

12. The package of claim 1, wherein the collar is open with a gap between end segments.

13. The package of claim 1, further comprising a fin seal extending along the longitudinal axis, wherein the collar has first and second ends spaced apart from the fin seal.

14. A method of dispensing the food product from the package of claim 1, the method comprising: separating the second end portion from the side wall of the package; moving the collar in a direction toward the first end of the bag to expose the food product; removing a portion of the food product from the package through the opening; moving the collar in a direction away from the first end of the bag to a position above a top surface of the food product remaining in the bag; rotating the collar about the longitudinal axis to twist a portion of the side wall and block the access opening; and sliding the collar in a direction toward the first end of the bag over the side wall with the opening being blocked by the twisted portion of the side wall.

15. A method of manufacturing the recloseable flexible package of claim 1, the method comprising: providing a continuous film of packaging material in the form of a tube; sealing portions of the film to form the first and second ends of the package; and forming the collar in the film between the first and second ends, the collar being more proximate to the second end than to the first end, the collar being more rigid than adjacent portions of the film.

16. The method of claim 15, wherein the forming a collar includes moving the first and second ends of the film toward each other to form at least one portion of film having an accordion shape.

17. The method of claim 16, further comprising using sealing jaws to compress the at least one accordion-shaped portion.

18. A package containing a food product, the package comprising a flexible film bag having a side wall, a closed first end, a closed second end portion separable from the side wall to provide an access opening, a longitudinal axis passing through the first and second ends, a collar attached to the side wall between the second end portion and the first end, the closed second end portion extending above the collar and being spaced from the collar by a portion of the side wall extending above the collar, the collar being more rigid than the side wall and being configured to rotate about the longitudinal axis to twist at least a portion of the side wall and block the access opening after removal of the second end portion.

19. The package of claim 18, wherein the collar is formed on an interior surface of the side wall.

20. The package of claim 18, wherein the second end portion includes a seal.

21. The package of claim 1, wherein the collar comprises multiple folds of the flexible film side wall sealed together at proximal and distal ends of the multiple folds.

22. the package of claim 21, wherein the collar comprises an accordion-shaped region including multiple layers of the flexible film side wall sealed together at proximal and distal ends of the multiple folds.

23. The package of claim 1, wherein the collar and the flexible film side wall are made of an identical material and the collar is a UV-cured portion of the flexible film side wall.

24. The package of claim 18, wherein the collar and the side wall are made of an identical material and the collar is a UV-cured portion of the side wall.

25. The package of claim 1, wherein the side wall is rigid such that the side wall remains upright after the side wall is no longer in frictional engagement with portions of the food product removed by a user.

26. The package of claim 18, wherein the side wall is rigid such that the side wall remains upright after the side wall is no longer in frictional engagement with portions of the food product removed by a user.

* * * * *